US006374706B1

(12) United States Patent
Newman

(10) Patent No.: US 6,374,706 B1
(45) Date of Patent: Apr. 23, 2002

(54) SUCKER ROD TOOL

(76) Inventor: Frederic M. Newman, 1618 W. Dengar, Midland, TX (US) 79705

( * ) Notice: Subject to any disclaimer, the term of this patent is extended or adjusted under 35 U.S.C. 154(b) by 0 days.

(21) Appl. No.: 09/768,551

(22) Filed: Jan. 25, 2001

(51) Int. Cl.[7] ..... B23B 13/50
(52) U.S. Cl. ..... 81/57.34; 81/57.16
(58) Field of Search ..... 81/57.16, 57.34, 81/57.38, 469, 470, 467, 472

(56) References Cited

U.S. PATENT DOCUMENTS

| | | | | |
|---|---|---|---|---|
| 3,768,573 | A | | 10/1973 | Jennings |
| 3,847,040 | A | | 11/1974 | Bufkin |
| 3,955,662 | A | | 5/1976 | Thackston |
| 3,964,552 | A | | 6/1976 | Slator |
| 4,305,472 | A | | 12/1981 | Brossette |
| 4,501,335 | A | | 2/1985 | Gann |
| 4,592,125 | A | | 6/1986 | Skene |
| 4,679,469 | A | | 7/1987 | Coyle, Sr. |
| 4,700,787 | A | | 10/1987 | Buck et al. |
| 4,730,254 | A | | 3/1988 | Voden, Jr. |
| 4,938,109 | A | | 7/1990 | Torres et al. |
| 5,040,827 | A | | 8/1991 | DeLange |
| 5,099,725 | A | * | 3/1992 | Bouligny, Jr. et al. ..... 81/57.34 |
| RE34,063 | E | | 9/1992 | Vincent et al. |
| 5,195,406 | A | | 3/1993 | Lindqvist |
| 5,668,328 | A | | 9/1997 | Steber et al. |
| 5,823,074 | A | * | 10/1998 | Ahlstone ..... 81/57.34 |
| 5,890,403 | A | | 4/1999 | Buck |
| 6,003,412 | A | * | 12/1999 | Dlask et al. ..... 81/57.34 |
| 6,263,763 | B1 | * | 7/2001 | Feigel, Jr. et al. ..... 81/57.34 |

* cited by examiner

*Primary Examiner*—D. S. Meislin
(74) *Attorney, Agent, or Firm*—Robert J. Harter

(57) ABSTRACT

Tongs for assembling sucker rods of oil wells include a switch that senses movement of the tong's backup wrench relative to the tong's housing. When screwing two sucker rods into a threaded coupling, an upper jaw of the tongs rotates an upper sucker rod relative to a lower sucker rod, while the backup wrench holds the lower rod relatively stationary. When the tongs apply a torque that indicates that the threaded connection is beyond hand tight (i.e., at the shoulder point), a torque reaction force kicks the backup wrench to a position that trips the switch. A control responsive to the switch and a rotation sensor monitors and/or controls the threaded connection's circumferential displacement past the shoulder point. By sensing the position of the backup wrench directly, the switch can consistently identify the shoulder point independent of the tong's. hydraulic pressure, thus avoiding oil viscosity related errors.

17 Claims, 6 Drawing Sheets

SUCKER ROD TOOL

BACKGROUND OF THE INVENTION

1. Field of the Invention

The subject invention generally pertains to a tool for assembling threaded sucker rods of oil wells and other wells, and more specifically pertains to a switch on a rod tong that detects when the shoulder point of the rod's threaded connection has been reached.

2. Description of Related Art

Oil wells and many other types of wells often include a sucker rod pump for pumping oil or other fluid from deep within a well bore to the surface of the earth. A sucker rod pump is a reciprocating piston/cylinder type pump situated at the bottom of a long string of tubing that conveys the pumped fluid upward to the earth's surface. An oscillating drive at ground level is coupled to raise and lower the pump's piston by way of long string of sucker rods that may extend over 10,000 feet through the interior of the tubing. The string of sucker rods is comprised of individual solid rods of about 0.5 to 1.125 inches in diameter and about 25 to 30 feet long. Each sucker rod has an axial shoulder and male threads at each end that allow the rods to be tightly connected end-to-end by way of female threaded rod couplings (also referred to as boxes). The couplings also serve as a wear surface that protects the more expensive sucker rod from wear as the string of sucker rods may slide up and down along the interior of the tubing for millions of cycles over its lifetime.

Properly tightening each threaded joint of a string of sucker rods is critically important, as even a single improperly tightened joint can lead to a premature separation, fatigue cracking, or complete breakage of the string. This not only interrupts the ongoing operation of the well, but repairing a string of sucker rods is very expensive, due to its inaccessibility. Usually the entire string of sucker rods is removed from the well bore to repair a single joint. For a 10,000-foot string of 25-foot sucker rods, there are about 800 threaded joints. Thus, a reliable system is needed to properly tighten every single one.

Today, power rod tongs are possibly the most common tools for assembling and disassembling a string of sucker rods. Conventional tongs, such as those provided by BJ-Hughes Machinery of Houston, Tex., includes two sets of jaws: one set being driven to rotate relative to the other. To assemble a new joint, a sucker rod is first manually screwed hand-tight into each end of a coupling. The rod tong is positioned to engage one set of tong jaws with mating flats of one sucker rod, and the other set of jaws with mating flats of the other sucker rod. This places the coupling generally between, but spaced apart from, the two sets of jaws. Actuating the tong rotates one rod relative to the other, so that both rods screw tightly into the coupling generally at the same time. As the connection tightens, the tong eventually stalls at a torque or pressure preset by the operator. When the tong stalls, the operator assumes that the connection is properly torqued with the proper preload.

Some rod tongs may shut off automatically in response to a switch, as disclosed in U.S. Pat. No. 3,768,573. In this case, a hydraulically actuated switch cuts out the drive motor shortly after the hydraulic pressure exceeds a predetermined limit. The hydraulic pressure that actuates the switch is the same pressure that drives the hydraulic motor. This poses several possibilities for error, as the hydraulic pressure driving the motor is not a reliable indicator of the actual torque applied to the sucker rods. For example, at the beginning of the workday, the switch may be prematurely tripped by abnormally high pressure caused by cold, viscous hydraulic fluid or excessive friction in the drive mechanism of the tongs. Later in the day, as the hydraulic fluid warms up with use, switch actuation may be delayed, which may cause the sucker rods to be over tightened.

SUMMARY OF THE INVENTION

To improve the accuracy of tightening rod tongs, it is an object of some embodiments of the invention to consistently identify a shoulder point of a sucker rod connection, and do so substantially independently of the tong motor's hydraulic pressure.

A second object is to provide a rod tong with the ability to consistently identify a shoulder point of a sucker rod connection.

A third object is to provide a device for adjusting the point at which a rod tong identifies a shoulder point.

A fourth object is to provide a rod tong with a counter that accurately measures how far a first set of jaws rotates relative to a backup wrench.

A fifth object is to provide a rod tong with a pin connector that allows a backup wrench to pivot and slide relative to the tong's housing.

A sixth object of some embodiments of the invention is to enable rod tongs to identify a shoulder point of a sucker rod connection even if the motor driving the tongs is not a hydraulic motor.

A seventh object of some embodiments of the invention is to turn off a rod tong automatically and with repeatability by doing so substantially independently of the tong motor's hydraulic pressure.

These and other objects of the invention are provided by sucker rod tool that includes a switch that responds to movement of a backup wrench as the rod tool tightens a pair of sucker rods.

DESCRIPTION OF THE PREFERRED EMBODIMENTS

Figure 1:
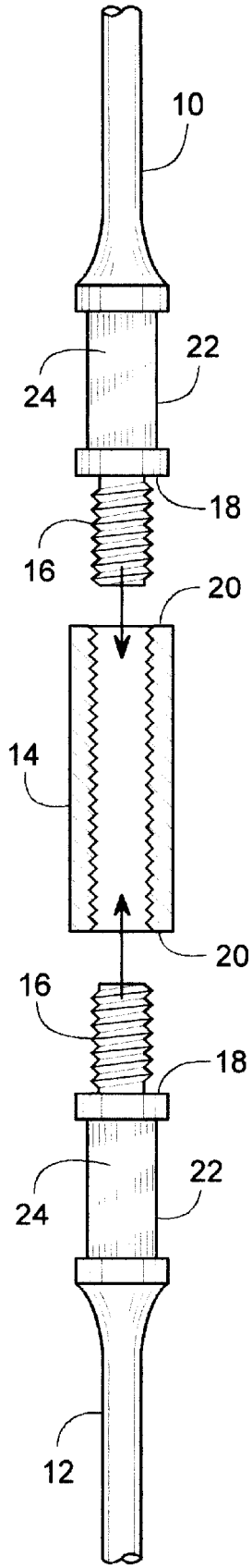
FIG. 1 is front view two sucker rods about to be screwed into a coupling, with the coupling being shown in cross-section.

Two conventional sucker rods 10 and 12 about to be screwed into opposite ends of a threaded rod coupling 14 are shown in FIG. 1. Upper sucker rod 10 and lower rod 12 each include a threaded pin 16 that screws into coupling 14, a shoulder 18 adapted to tightly abut an axial face 20 of coupling 14, and a drive head 22 that provides a set of flats 24 suitable to be engaged by a sucker rod tool used for tightening the sucker rods.

Figure 2:
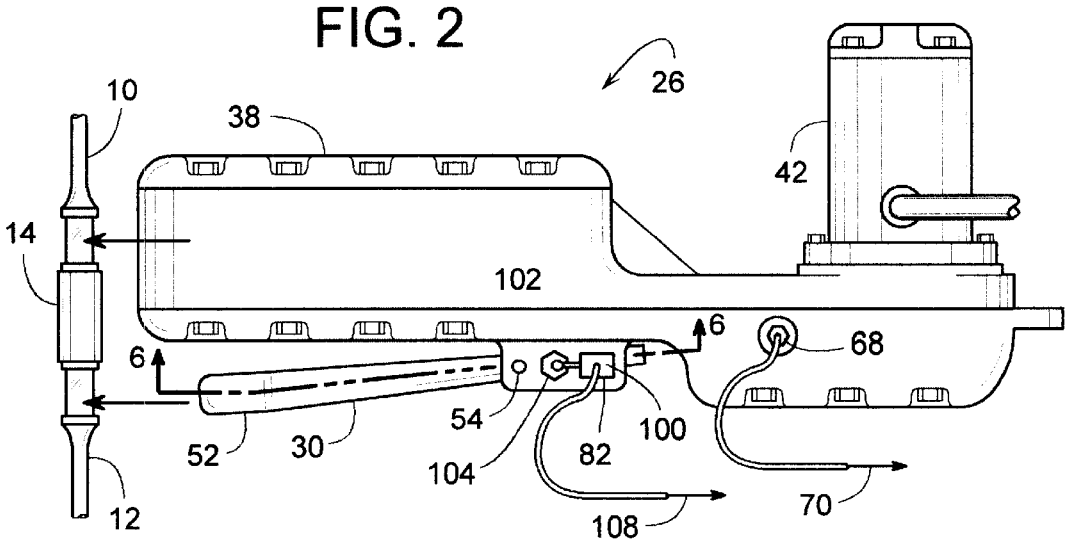
FIG. 2 is a side view of a sucker rod connection about to be tightened by a sucker rod tool according to one embodiment of the invention.
Figure 3:
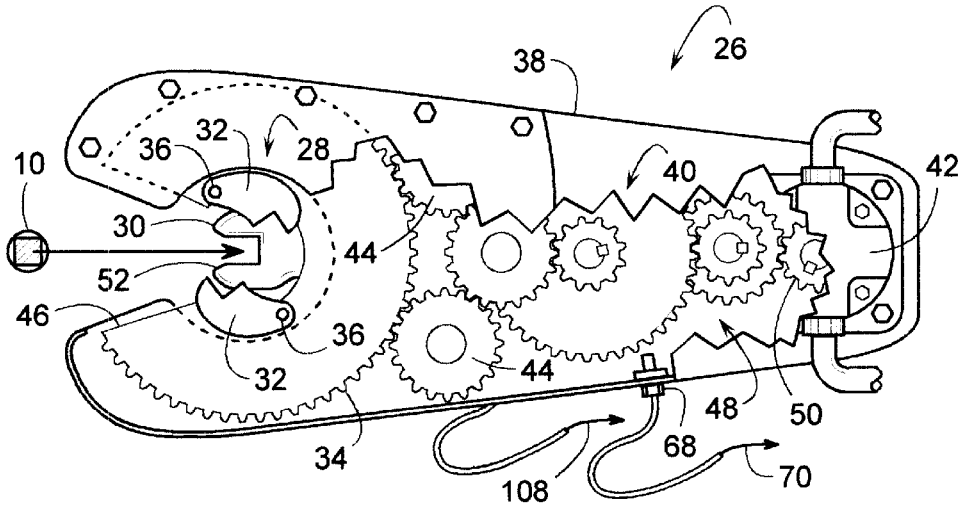
FIG. 3 is a top view of the FIG. 2, with one of the sucker rods shown in cross-section and portions of the tool cut away.
Figure 4:
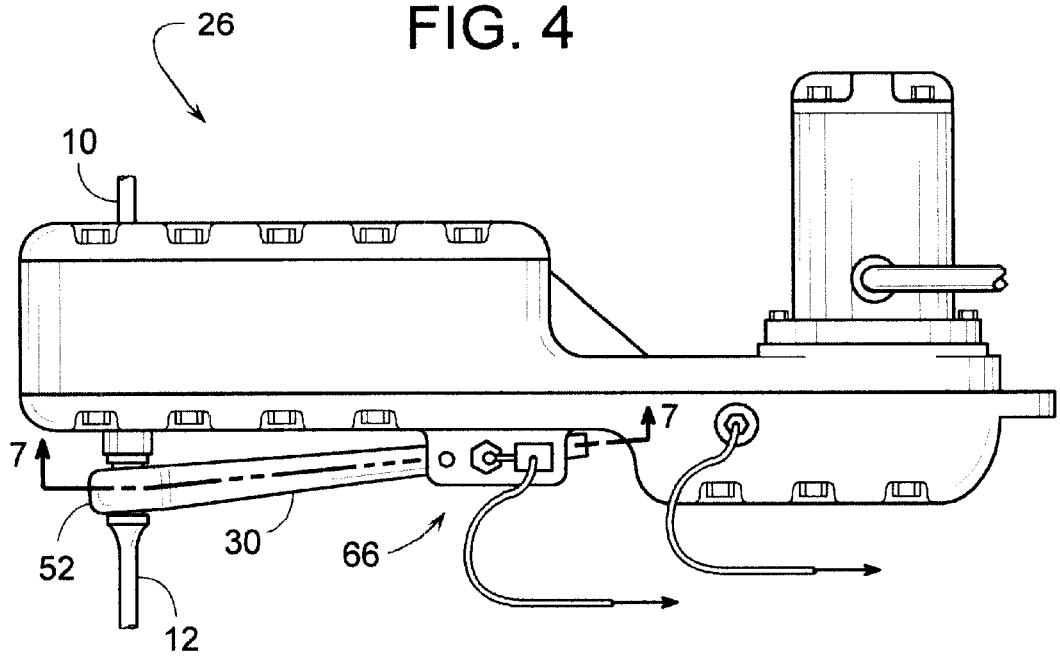
FIG. 4 is a side view of a sucker tool tightening a sucker rod connection.
Figure 5:
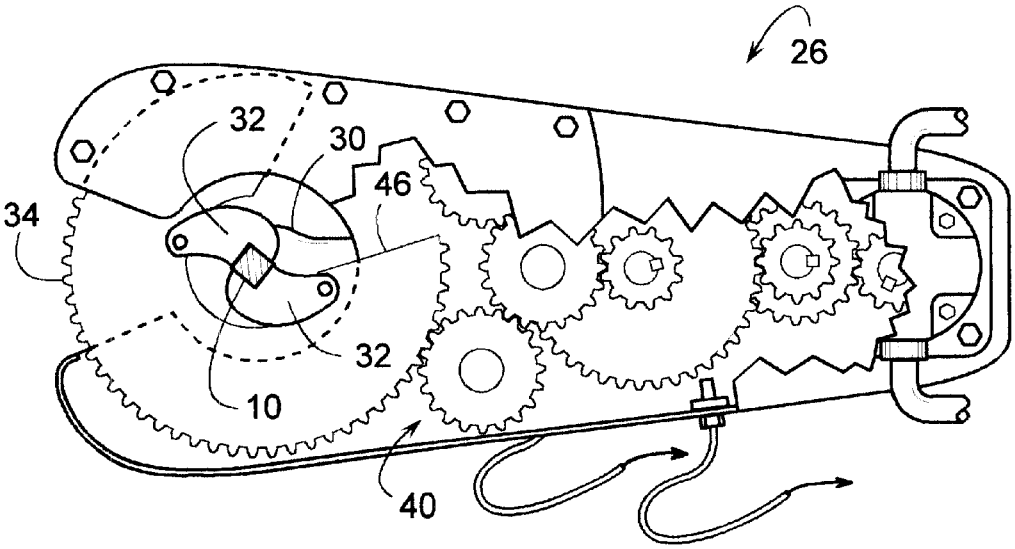
FIG. 5 is a top view of the FIG. 2, with one of the sucker rods shown in cross-section and portions of the tool cut away.

One example of a sucker rod tool is tongs 26 of FIGS. 1–7. Tongs 26 includes a rotational upper jaw 28 for engaging head 22 of upper rod 10 and a backup wrench 30 for engaging head 22 of lower rod 12. In this example, upper jaw 28 includes two grippers 32 pivotally attached to a gear segment 34 (outer ring assembly) by way of pins 36. Pins 36 allow grippers 32 to pivot in and out of engagement with head 22 of upper rod 10, while gear segment 34 renders jaw 28 rotational relative to a tong housing 38. FIGS. 2 and 3 show tongs 26 disengaged from the sucker rods, and FIGS. 4 and 5 show tongs 26 engaging the rods.

In FIGS. 3 and 5, portions of housing 38 are cutaway to more clearly illustrate a drive train 40 that couples a motor 42 (hydraulic, electric, pneumatic, etc.) to upper jaw 28. Drive train 40 includes two drive gears 44 so that at least one of them remains in driving contact with gear segment 34 at all times, as gear segment 34 has a discontinuity or opening 46 for receiving and releasing rod 10. A set of speed reducing gears 48 couples drive gears 44 to an output pinion gear 50 of motor 42. Thus, motor 42 turning pinion 50 rotates gear segment 34 at a reduced speed to provide upper jaw 28 with sufficient torque to be able to tightly screw rods 10 and 12 into coupling 14. To disassemble or unscrew at least one sucker rod 10 or 12 from coupling 14, the rotational direction of motor 42 is simply reversed. Tongs 26 is quite similar in structure and function as a conventional set of tongs (e.g., tongs provided by BJ-Hughes, Inc. of Houston, Tex.), but with some important and novel modifications.

The modifications are primarily associated with backup wrench 30. A head 52 of wrench 30 is adapted to engage flats 24 of lower sucker rod 12. A pin 54 held between two lugs 56 and 58 of tong housing 38 pivotally couples a shank 60 of wrench 30 to housing 38. This allows wrench 30 to pivot about a longitudinal centerline 62 of pin 54, so head 52 of wrench 30 can move vertically to accommodate variations in the distance between the heads of upper and lower rods 10 and 12.

Figure 6:
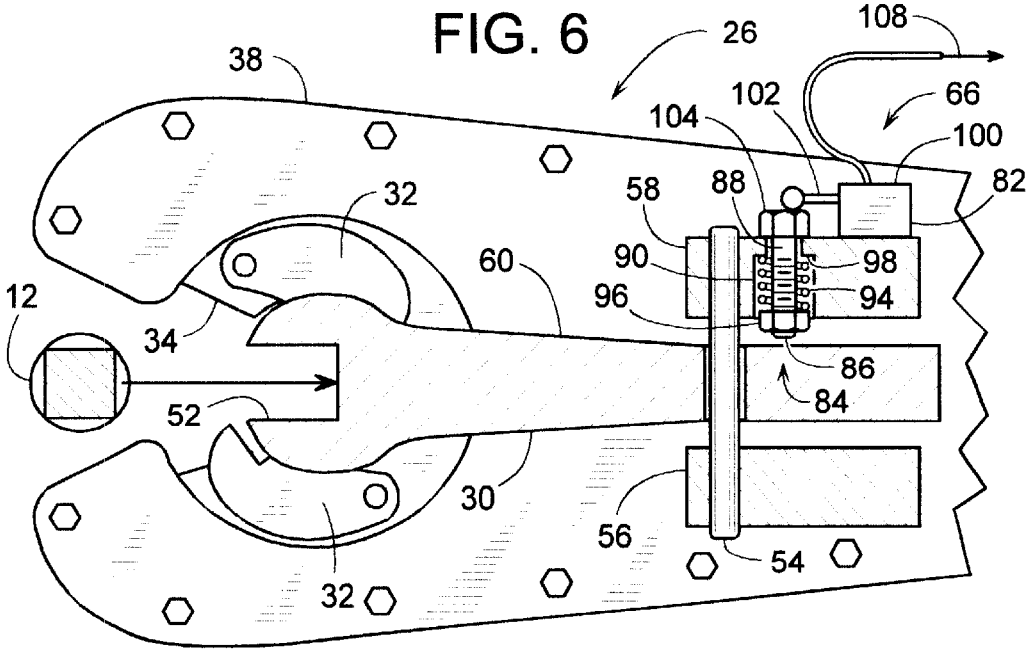
FIG. 6 is a cross-sectional view taken along line 6—6 of FIG. 2.
Figure 7:
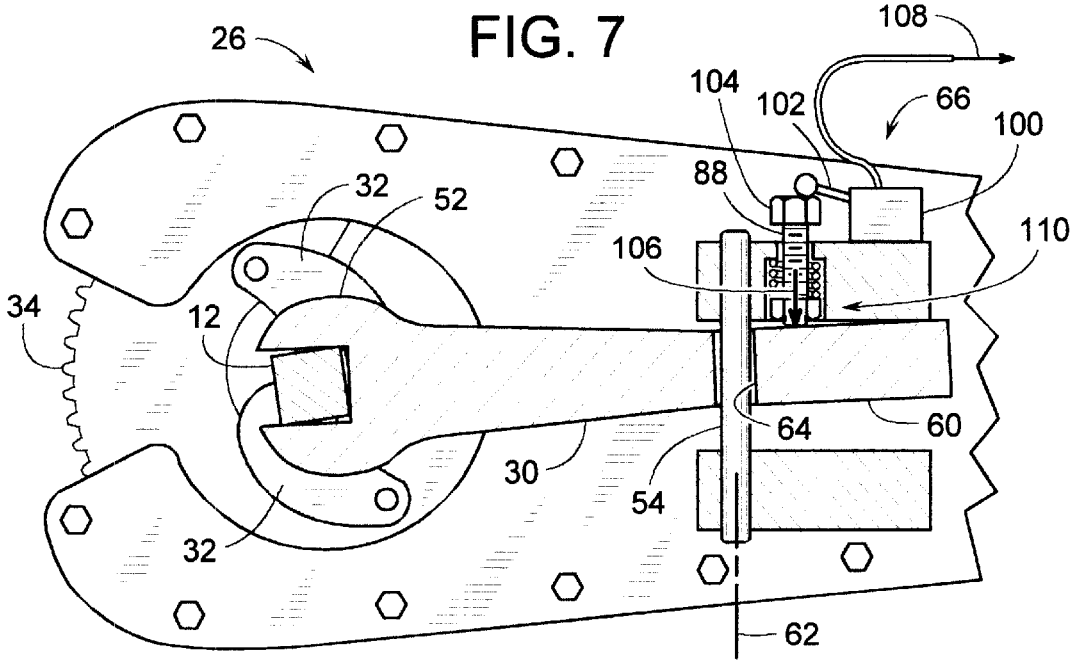
FIG. 7 is a cross-sectional view taken along line 7—7 of FIG. 4.

To allow wrench 30 to move between a relaxed position of FIG. 6 and a torqued position of FIG. 7, sufficient clearance is provided between shank 30 and lugs 56 and 58 and between pin 54 and a hole 64 in shank 30. Such clearance allows wrench 30 to slide axially in a direction parallel to centerline 62 and to rotate slightly about a vertical axis relative to housing 38. Such movement serves as a trigger that enables a switch system 66 to determine accurately and repeatedly when tongs 26 applies a certain amount of torque to rods 110 and 12.

This can be important when it is desirable to identify when a sucker rod connection reaches its shoulder point, i.e., when the connection is hand tight and further tightening begins stretching the rods' threaded pins 16. Once the shoulder point is reached, tongs 26 can rotate upper jaw 28 a predetermined amount to accurately achieve a proper preload or axial stretch within threaded pins 16.

Figure 8:
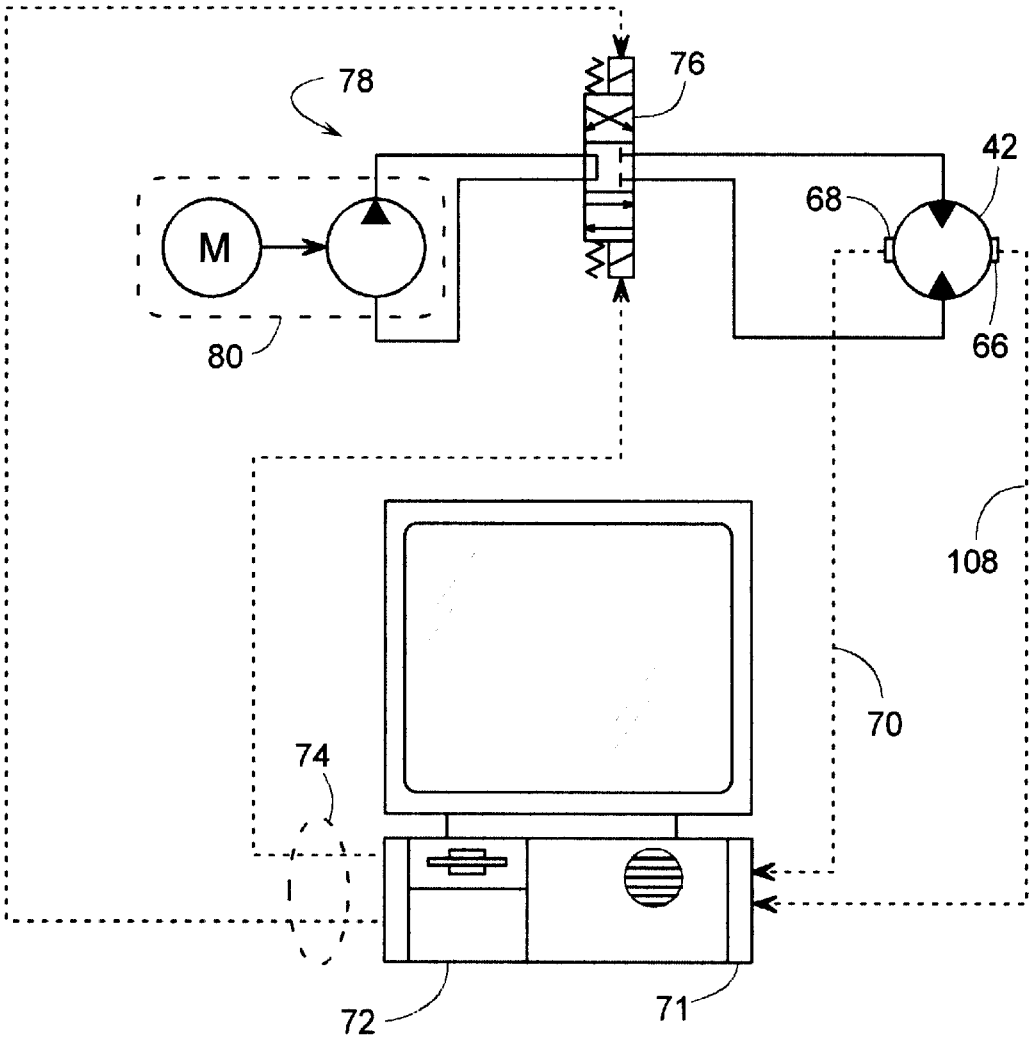
FIG. 8 is a schematic diagram of a sucker rod tool showing control aspects of the tool.

To accurately measure the extent to which rods 10 and 12 have been tightened beyond their shoulder point, tongs 26 are provided with a sensor 68 and a counter 71 (FIG. 8) that measure the rotation of jaws 28, motor 42 and/or drive train 40. Although sensor 68 can be any type of rotational sensor, in some embodiments, sensor 68 is a DZH series Hall effect sensor by Electro Corporation of Sarasota, Fla., which senses a magnetic disturbance created by each passing ferro-magnetic tooth of one of the gears of drive train 40. A signal 70 from sensor 68 is fed back to counter 71. Although counter 71 is schematically illustrated to represent any type of counter, in this example counter 71 is provided by a computer 72, which encompasses any one of a variety of programmable or dedicated control circuits including, but not limited to, a microprocessor associated with appropriate memory and input/output boards; a microcomputer, computer, or PC; a PLC (programmable logic controller); and a myriad of hard-wired electrical circuits comprised of discrete electrical components and/or solid-state integrated circuits. After counting a predetermined number of pulses of signal 70, computer 72 can record the results or generate an output signal 74 that stops motor 42. Stopping motor 42 can be accomplished in different ways including, but not limited to, de-energizing an electric motor or stopping a hydraulic motor by shifting a directional valve 76 of a hydraulic circuit 78 to a neutral position, as shown in FIG. 8. Valve 76 in its neutral position shunts any hydraulic fluid that a hydraulic pump system 80 would otherwise force in a forward or reverse direction through motor 42.

However, to sense the shoulder point consistently (i.e., accurately and repeatedly), it is preferred to sense the movement or reaction of wrench 30 directly and independently of any hydraulic pressure associated with hydraulic circuit 78 (i.e., independent of any hydraulic pressure of any hydraulic fluid circulating through tongs 26). The term, "circulating" refers to a fluid that is in fluid communication with fluid that can travel along a path that eventually leads back to its starting point without having to backtrack. To this end, switch system 66 has a first portion 82 (e.g., a limit switch housing) that is relatively fixed relative to tong housing 38 and a second portion 84 (e.g., a spring-loaded plunger) that is adapted to engage and move with backup wrench 30. Spring-loaded plunger 84 has one end 86 adapted to be engaged by shank 60 of wrench 30. In some embodiments, plunger 84 comprises a bolt 88 disposed within a cavity 90 of lug 58. With conventional tongs, cavity 90 is typically used to house a small hydraulic cylinder (similar to cylinder 92 of FIGS. 9 and 10) having a rod end that when pushed against by shank 60 of wrench 30 develops a pressure within the cylinder. A pressure gage on that cylinder would then indicate the force that wrench 30 exerts against the rod end of the cylinder. However, in the preferred embodiment of FIGS. 6 and 7 such a cylinder is replaced by a spring 94 compressed between a nut 96 on bolt 88 and a flange 98 at the base of cavity 90. The location and structure of spring 94 is schematically illustrated to encompass any appropriately located structure that urges the bolt portion of switch system 66 toward wrench 30. Examples of spring 94 include, but are not limited to, a compression spring, a tension spring, a pneumatic cylinder, a hydraulic cylinder, a resilient polymeric cylinder, one or more Belleville washers, etc. An electric limit switch 100 whose housing 82 is attached to tong housing 38 is actuated by an actuator arm 102 resting on a head 104 of bolt 88. Switch 100 is schematically illustrated to encompass any device that can change states to create a signal 108.

As tongs 26 applies a predetermined amount of torque to sucker rods 10 and 12, backup wrench 30 shifts from its relaxed position of FIG. 6 to its torqued position of FIG. 7. Upon moving to its torqued position, shank 60 of wrench 30 pushes against bolt end 86 and, with sufficient torque, overcomes a spring force 106, as shown in FIG. 7. This causes bolt head 104 to push actuator 102, which changes limit switch 100 from a normal state of FIG. 6 to an actuated state of FIG. 7, thereby creating signal 108. The switch's normal state could be open electrical contacts and its actuated state could be closed contacts, or vice versa.

With wrench 30 at or near its torqued position, spring force 106 urges wrench 30 back towards its relaxed position. An adjustment 110 adjusts the spring preload or amplitude of force 106 by adjusting the extent to which nut 96 is screwed onto bolt 88. The further nut 96 is screwed onto bolt 88, the greater is force 106, unless, of course, wrench 30 forces spring 94 to bottom out. Increasing force 106 raises the required torque for tripping switch 100.

In response to receiving signal 108, computer 72 can respond in a monitoring or controlling manner. For monitoring the tightening of a sucker rod connection, tongs 26 tightens and stops the tightening process in a conventional manner (similar to other tongs and independent of computer 72). However, computer 72 can still determine whether the sucker rod connection has been properly tightened by counting the number of pulses of signal 70 that occur after signal 108 identifies the shoulder point. Computer 72 can record the results and/or provide the operator of the tongs with feedback, such as a green or red light to indicate respectively an acceptable or unacceptable connection. An acceptable connection would be when the number of pulses of signal 70 falls within a predetermined range. On the other hand, when controlling the tightening process, computer 72 would automatically stop tongs 26 after upper jaw 28 rotates a predetermined amount beyond the shoulder point. Signal 70 would indicate that the shoulder point has been reached, and computer 72 would measure the amount of rotation of upper jaw 28 by counting the pulses of signal 108 Computer 72 can stop tongs 26 by generating a signal 74 that shifts valve 76 to its neutral position, as shown in FIG. 8.

Figure 9:
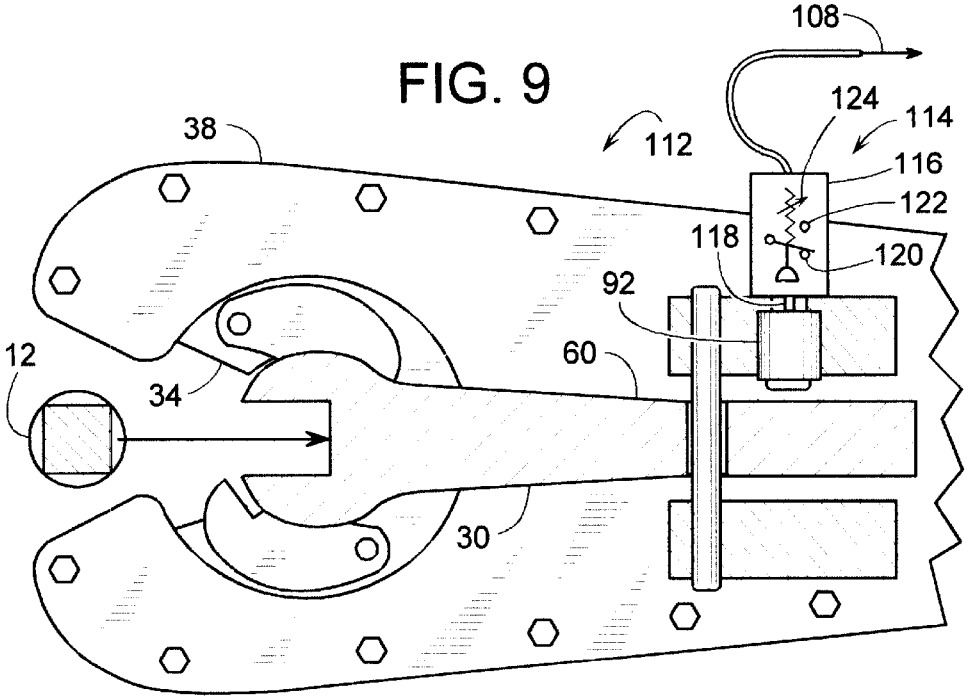
FIG. 9 is similar to FIG. 6, but of another embodiment of the invention.
Figure 10:
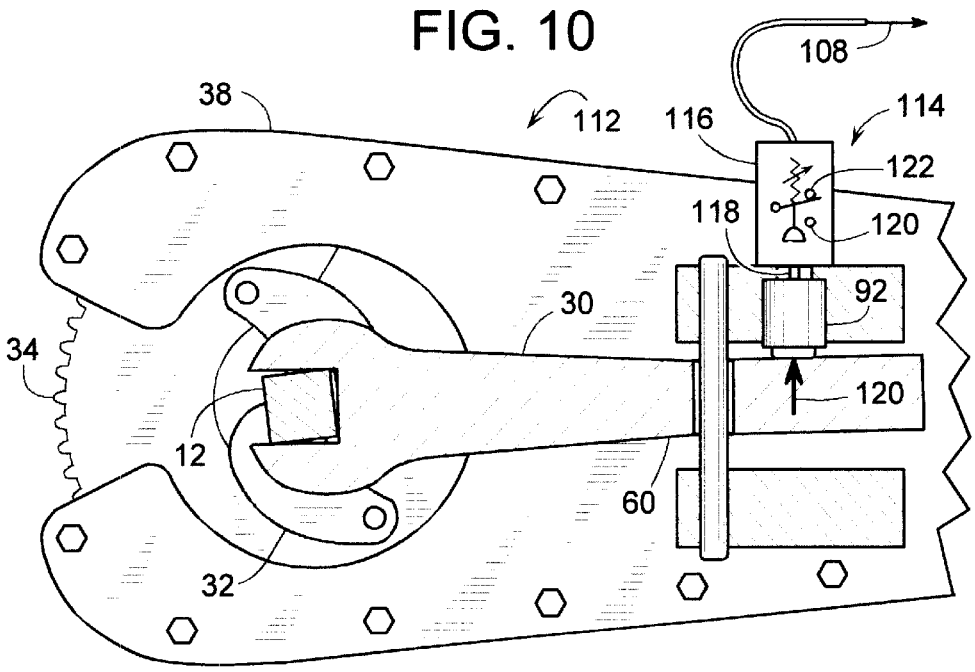
FIG. 10 is similar to FIG. 7, but of another embodiment of the invention.

In another embodiment of a rod tongs 112, shown in FIGS. 9 and 10, a switch system 114 includes a hydraulic cylinder 92 coupled to a pressure switch 116 through a hydraulic line 118. Upon tongs 112 tightening rods 10 and 12 to their shoulder point, backup wrench 30 shifts from its relaxed position of FIG. 9 to its torqued position of FIG. 10. In the torqued position, shank 60 of wrench 30 pushes against cylinder 92 with a force 120 that builds hydraulic pressure inside cylinder 92. Line 118 conveys the pressure to switch 116. As the pressure within cylinder 92 reaches a predetermined limit indicative of the shoulder point being reached, switch 116 changes from its normal state of FIG. 9 to its actuated state of FIG. 10. In the normal state, a set of normally closed contacts 120 of switch 116 are closed and a set of normally open contacts 122 are open. In the actuated state, contacts 120 open and contacts 122 close. Either set of contacts 120 or 122 can be used to generate signal 108. The predetermined force indicative of the shoulder point is adjustable, as indicated by adjustment 124 of pressure switch 116. In other words, pressure switch 116 has an adjustable pressure setting. However, since the hydraulic fluid in cylinder 92 and line 118 does not circulate, the actuation of switch system 114 is still independent of any hydraulic pressure of any hydraulic fluid that may happen to circulate through tongs 112.

Although the invention is described with reference to a preferred embodiment, it should be appreciated by those skilled in the art that various modifications are well within the scope of the invention. For example, although tongs are preferably driven by a hydraulic motor through which hydraulic fluid circulates, tongs driven by electric or pneumatic motors are well within the scope of the invention. Therefore, the scope of the invention is to be determined by reference to the claims that follow.

I claim:

1. A sucker rod tool adapted to torque an upper sucker rod relative to a lower sucker rod, comprising:

a tong housing;

an upper jaw rotatably coupled to said tong housing and being adapted to engage said upper sucker rod;

a backup wrench coupled to said tong housing and being adapted to engage said lower sucker rod, said backup wrench being moveable relative to said tong housing between a torqued position and a relaxed position;

a spring coupled to said tong housing and being adapted to exert a force that urges said backup wrench toward said relaxed position; and a switch system coupled to said tong housing and being responsive to movement of said backup wrench such that said switch system changes from a normal state to an actuated state upon said backup wrench moving from said relaxed position to said torqued position regardless of any hydraulic pressure of any hydraulic fluid that may happen to circulate through said sucker rod tool.

2. The sucker rod tool of claim 1, further comprising an adjustment that adjusts the amplitude of the force that urges said backup wrench toward said relaxed position.

3. The sucker rod tool of claim 1, further comprising a motor mounted to said tong housing and being adapted to rotate said upper jaw a pre determined extent after said switch system changes from said normal state to said actuated state.

4. The sucker rod tool of claim 1, further comprising a motor mounted to said tong housing and coupled to said upper jaw by way of a drive train, said motor being responsive to said switch system such that said motor rotates said upper jaw a predetermined amount after said switch system changes from said normal state to said actuated state.

5. The sucker rod tool of claim 4, further comprising a counter that measures the amount of rotation of said upper jaw by sensing movement of at least one of said motor, said drive train, and said upper jaw.

6. The sucker rod tool of claim 1, further comprising a pin that pivotally couples said backup wrench to said tong housing.

7. The sucker rod tool of claim 6, wherein said backup wrench can slide in an axial direction parallel to a longitudinal centerline of said pin.

8. The sucker rod tool of claim 1, wherein said switch system includes a set of normally closed contacts that open upon said switch system changing from said normal state to said actuated state.

9. The sucker rod tool of claim 1, wherein said switch system includes a set of normally open contacts that close upon said switch system changing from said normal state to said actuated state.

10. The sucker rod tool of claim 1, wherein said switch system includes a first portion substantially fixed relative to said housing and a second portion being adapted to engage and move with said backup wrench as said backup wrench approaches said torqued position.

11. A sucker rod tool adapted to torque an upper sucker rod relative to a lower sucker rod, comprising:

a tong housing;

an upper jaw rotatably coupled to said tong housing and being adapted to engage said upper sucker rod;

a motor mounted to said tong housing and coupled to said upper jaw by way of a drive train, said motor being adapted to rotate said upper jaw relative to said tong housing;

a backup wrench coupled to said tong housing and being adapted to engage said lower sucker rod, said backup wrench being moveable relative to said tong housing between a torqued position and a relaxed position;

a switch system having a first portion substantially fixed relative to said tong housing and a second portion being adapted to engage said backup wrench as said backup wrench approaches said torqued position, wherein said switch system changes from a normal state to an actuated state upon said backup wrench exerting a predetermined force against said second portion of said switch system; and a counter that measures the amount of rotation of said upper jaw by sensing movement of at least one of said motor, said drive train, and said upper jaw.

12. The sucker rod tool of claim 11, wherein said motor is responsive to said switch system and said counter such that said motor rotates said upper jaw a predetermined amount after said switch system changes from said normal state to said actuated state.

13. The sucker rod tool of claim 11, further comprising a pin that pivotally couples said backup wrench to said tong housing.

14. The sucker rod tool of claim 13, wherein said backup wrench can slide in an axial direction parallel to a longitudinal centerline of said pin.

15. The sucker rod tool of claim 11, wherein said switch system includes a set of normally closed contacts that open upon said switch system changing from said normal state to said actuated state.

16. The sucker rod tool of claim 11, wherein said switch system includes a set of normally open contacts that close upon said switch system changing from said normal state to said actuated state.

17. A sucker rod tool adapted to torque an upper sucker rod relative to a lower sucker rod, comprising:

a tong housing;

an upper jaw rotatably coupled to said tong housing and being adapted to engage said upper sucker rod;

a motor mounted to said tong housing and coupled to said upper jaw by way of a drive train, said motor being adapted to rotate said upper jaw relative to said tong housing;

a backup wrench adapted to engage said lower sucker rod and being moveable relative to said tong housing between a torqued position and a relaxed position;

a pin that pivotally couples said backup wrench to said tong housing with said backup wrench being able to slide in an axial direction parallel to a longitudinal centerline of said pin;

a spring coupled to said tong housing and being adapted to urge said backup wrench toward said relaxed position;

a switch system having a first portion substantially fixed relative to said housing and a second portion being adapted to engage and move with said backup wrench as said backup wrench approaches said torqued position, wherein said switch system changes from a normal state to an actuated state upon said backup wrench moving from said relaxed position to said torqued position regardless of any hydraulic pressure of any hydraulic fluid that may happen to circulate through said sucker rod tool, said motor being responsive to said switch system such that said motor rotates said upper jaw a predetermined amount after said switch system changes from said normal state to said actuated state; and a counter that measures the amount of rotation of said upper jaw by sensing movement of at least one of said motor, said drive train, and said upper jaw.

* * * * *